US008720340B1

(12) United States Patent
Kendrix

(10) Patent No.: US 8,720,340 B1
(45) Date of Patent: May 13, 2014

(54) ROCKET LAUNCHER

(76) Inventor: Henry Edward Kendrix, Kansas City, KS (US)

( * ) Notice: Subject to any disclaimer, the term of this patent is extended or adjusted under 35 U.S.C. 154(b) by 0 days.

(21) Appl. No.: 13/590,408

(22) Filed: Aug. 21, 2012

(51) Int. Cl.
*F42B 4/00* (2006.01)

(52) U.S. Cl.
USPC ..... 102/361; 102/342; 102/351

(58) Field of Classification Search
USPC ..... 102/335–361; 89/1.816; 86/20.1
See application file for complete search history.

(56) References Cited

U.S. PATENT DOCUMENTS

| | | | | | |
|---|---|---|---|---|---|
| 1,922,081 | A * | 8/1933 | Driggs, Jr. | ..... | 102/351 |
| 3,797,359 | A * | 3/1974 | Mawhinney et al. | ..... | 89/1.8 |
| 4,128,039 | A * | 12/1978 | Skliris | ..... | 89/1.803 |
| 4,917,015 | A * | 4/1990 | Lowery | ..... | 102/342 |
| 5,249,528 | A | 10/1993 | Lee | | |
| 5,627,338 | A * | 5/1997 | Poor et al. | ..... | 102/361 |
| 5,979,329 | A | 11/1999 | Collar | | |
| 6,286,429 | B1 | 9/2001 | Marietta et al. | | |
| 6,457,415 | B1 * | 10/2002 | Peter Sung Yan | ..... | 102/361 |
| 6,851,371 | B1 * | 2/2005 | Wah | ..... | 102/343 |
| D541,898 | S | 5/2007 | Marietta | | |
| 7,237,488 | B2 * | 7/2007 | Duescher et al. | ..... | 102/349 |
| 2011/0133494 | A1 * | 6/2011 | Hopkins et al. | ..... | 292/253 |

* cited by examiner

*Primary Examiner* — Michelle Clement
*Assistant Examiner* — John D Cooper
(74) *Attorney, Agent, or Firm* — Kyle Fletcher, Esq.

(57) ABSTRACT

The rocket launcher includes a launching tube that extends vertically from a flat base. The launching tube is of an undefined length and includes an opening adjacent to the bottom distal end where the flat base attaches. The flat opening includes a hinged door that opens to enable insertion of a rocket or firework therein. The door includes a plurality of small holes thereon so as to enable air to pass there through along with a fuse if applicable. A handle is also attached to and extends from the exterior surface of the launching tube, and enables the rocket launcher to be carried between uses.

14 Claims, 5 Drawing Sheets

ROCKET LAUNCHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of launching apparatuses, more specifically, a rocket or fireworks launching apparatus.

B. Discussion of the Prior Art

As will be discussed immediately below, no prior art discloses a rocket or fireworks launching tube that extends vertically from a flat base; wherein the launching tube includes an opening near a bottom end, and which includes a hinged door thereon; wherein the door includes a plurality of small holes thereon so as to enable air to pass across the door along with an applicable fuse; wherein the opening shall enable a rocket or fireworks to be inserted into the launching tube prior to launch; wherein a handle extends along an external surface of the launching tube to enable carrying the rocket launcher between uses.

The Deuscher et al. Patent (U.S. Pat. No. 7,237,488) discloses a bottle rocket launcher. However, the launcher is directed to adjusting a launch angle with respect to the ground, and does not include an opening and hinged door upon a vertically-oriented launch tube.

The Peter Sung Yen Patent (U.S. Pat. No. 6,457,415) discloses a launching device for launching multiple aerial fireworks. However, the launching device does not include an opening and hinged door to enable air to pass there through or to insert a rocket or firework or to extend a fuse there through.

The Lowery Patent (U.S. Pat. No. 4,917,015) discloses a fireworks rocket launch pad for holding and aiming a rocket as it is being launched, wherein the receiving member and the base can be adjusted for selecting the angle at which the rocket is launched. However, the launch pad does not include an opening along a side surface of the launching tube with a hinged door to enable access there through.

The Wah Patent (U.S. Pat. No. 6,851,371) discloses a firework launching device that is foldable. Again, the device does not include an opening near the base of a launching tube, and which includes a hinged door to enable acess there through.

The Lee Patent (U.S. Pat. No. 5,249,528) discloses a fireworks support kit that includes a pivotal support holder for the launch tube. Again, the fireworks support kit does not teach an opening along a side of a tube, which includes a hinged door to enable access there through.

The Collar Patent (U.S. Pat. No. 5,979,329) discloses a fireworks launching tube. Again, the launching tube does not include an opening on the side surface and adjacent to the bottom, which includes a hinged door for acres there through.

While the above-described devices fulfill their respective and particular objects and requirements, they do not describe a rocket or fireworks launching tube that extends vertically from a flat base; wherein the launching tube includes an opening near a bottom end, and which includes a hinged door thereon; wherein the door includes a plurality of small holes thereon so as to enable air to pass across the door along with an applicable fuse; wherein the opening shall enable a rocket or fireworks to be inserted into the launching tube prior to launch; wherein a handle extends along an external surface of the launching tube to enable carrying the rocket launcher between uses. In this regard the rocket launcher departs from the conventional concepts and designs of the prior art.

SUMMARY OF THE INVENTION

The rocket launcher includes a launching tube that extends vertically from a flat base. The launching tube is of an undefined length and includes an opening adjacent to the bottom distal end where the flat base attaches. The flat opening includes a hinged door that opens to enable insertion of a rocket or firework therein. The door includes a plurality of small holes thereon so as to enable air to pass there through along with a fuse if applicable. A handle is also attached to and extends from the exterior surface of the launching tube, and enables the rocket launcher to be carried between uses.

An object of the invention is to provide a rocket launcher that includes a launching tube extending vertically from a flat base and from which rockets and fireworks may be inserted through an opening on the side surface of the launching tube in order to launch said rocket or firework there from.

A further object of the invention is to provide an opening that is adjacent a bottom distal end of the launching tube, and which includes a hinged door there on, which enables the rocket or firework to be inserted through said opening, and said door closed thereafter.

A further object of the invention is to provide a door on said opening that includes a plurality of holes thereon so as to enable air to pass there through as well as an applicable fuse.

A further object of the invention is to provide a handle that is included and attached from the launching tube in order to carry the rocket launcher between uses.

Another object of the invention is to include an optional fallout shroud that attaches to and encircles a top distal end of the launching tube.

These together with additional objects, features and advantages of the rocket launcher will be readily apparent to those of ordinary skill in the art upon reading the following detailed description of presently preferred, but nonetheless illustrative, embodiments of the rocket launcher when taken in conjunction with the accompanying drawings.

In this respect, before explaining the current embodiments of the rocket launcher in detail, it is to be understood that the rocket launcher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rocket launcher.

It is therefore important that the claims be regarded as including such equivalent construction insofar as they do not depart from the spirit and scope of the rocket launcher. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
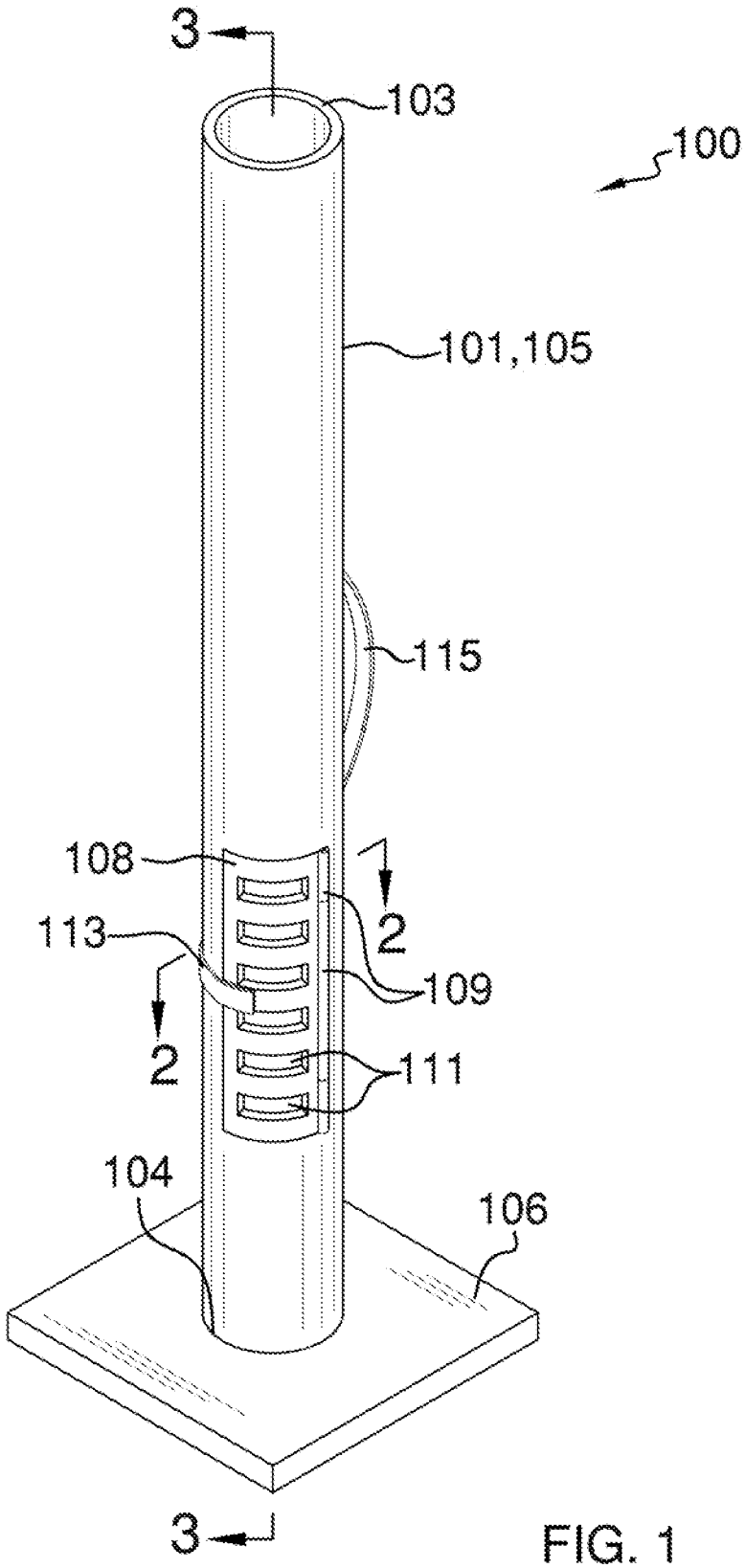
FIG. 1 illustrates a perspective view of the rocket launcher by itself and with the hinged door in a closed orientation.
Figure 2:
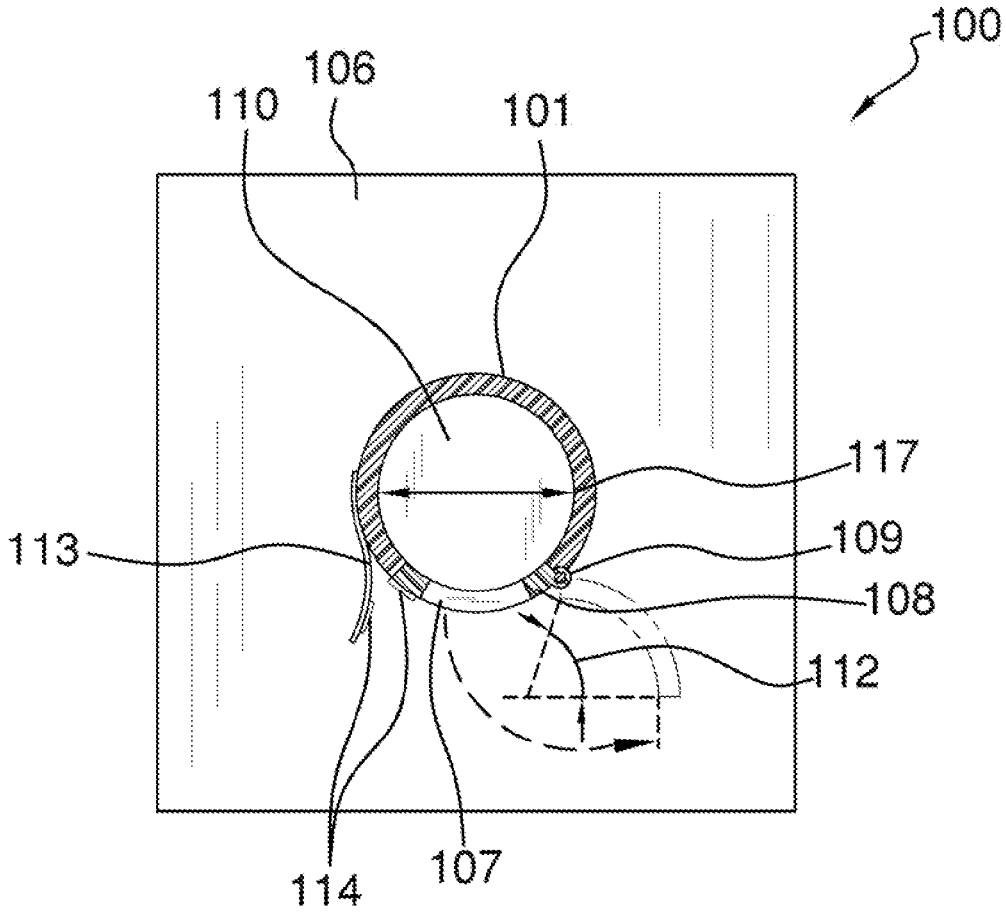
FIG. 2 illustrates a cross-sectional view of the rocket launcher along line 2-2 in FIG. 1, and depicting the rotational movement of the door with respect to the opening.
Figure 3:
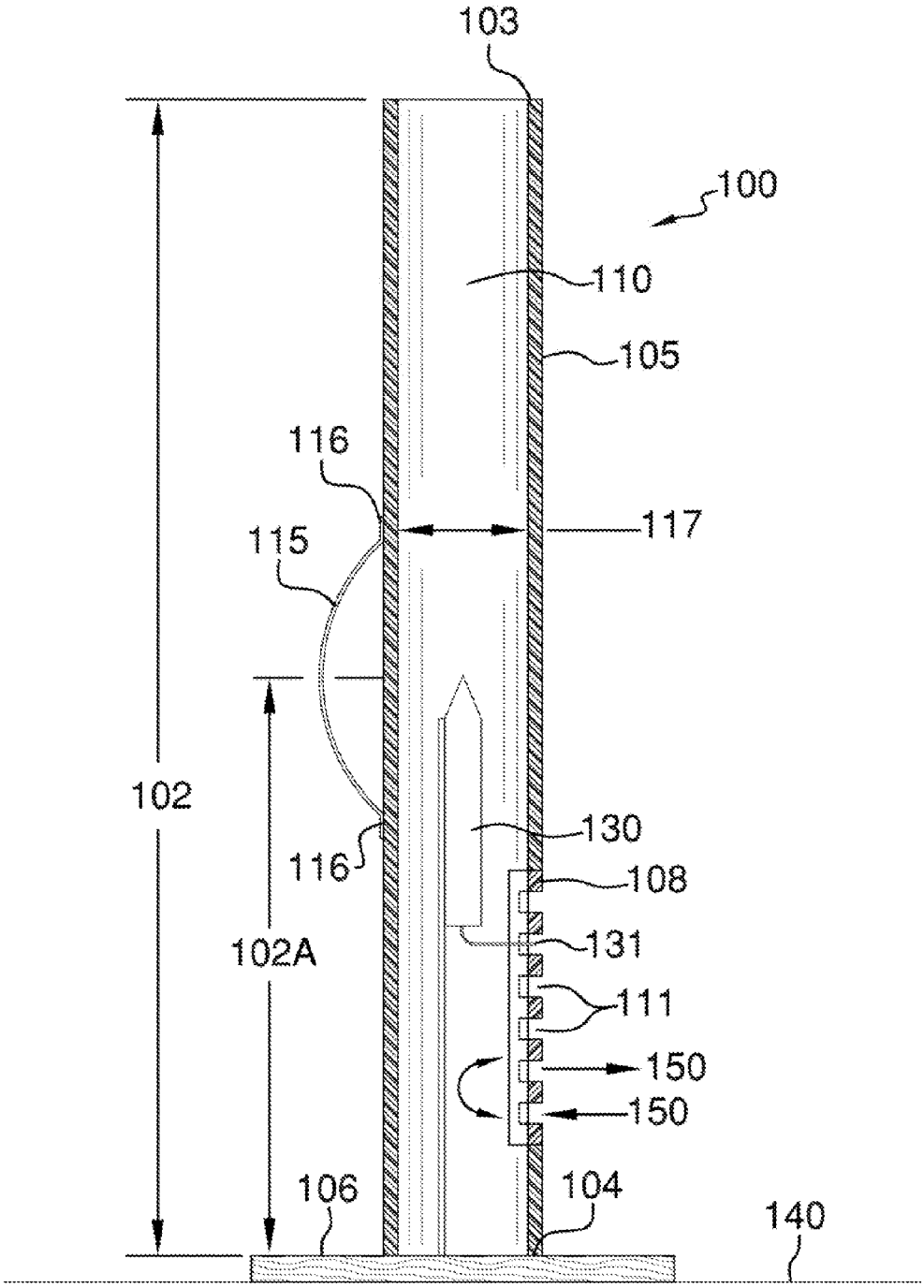
FIG. 3 illustrates a cross-sectional view of the rocket launcher along line 3-3 in FIG. 1, and depicting the construction of the launching tube as well as the handle and door.
Figure 4:
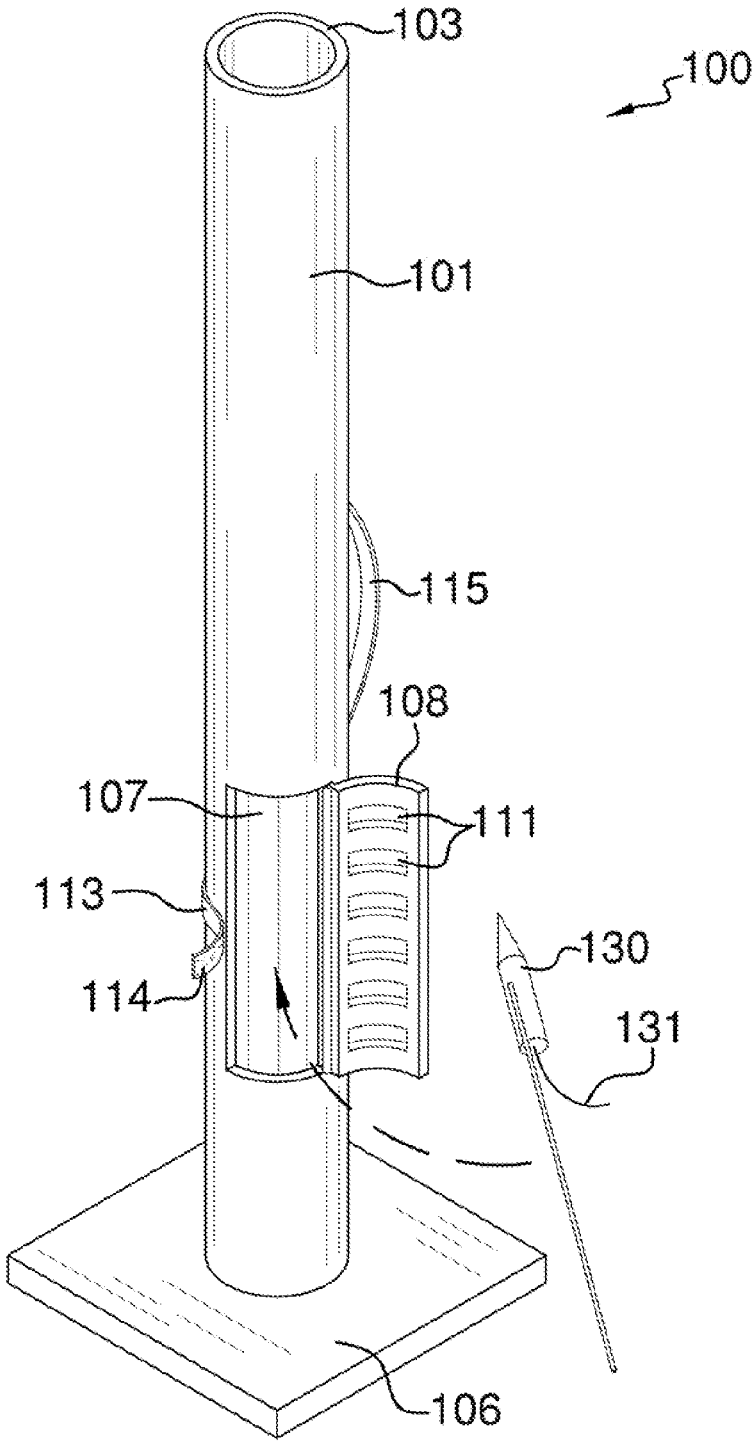
FIG. 4 illustrates a perspective view of the rocket launcher in which the door is opened while a rocket is being inserted through said opening.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" of "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-5. A rocket launcher 100 (hereinafter invention) includes a launching tube 101 of an undefined length 102 further defined with a top distal end 103 and a bottom distal end 104, and an exterior surface 105. The launching tube 101 is being used to support a firework or rocket 130 in a vertical orientation during launching. It should be noted that the term rocket 130 is being used to refer to both fireworks as well as small to medium sized rockets that a hobbyist launch, and which may include a fuse 131 to ignite the rocket propellant.

The launching tube 101 is rigidly affixed atop of a flat base 106 at the bottom distal end 104. Moreover, the launching tube 101 is vertically oriented with respect to a ground surface 140. The launching tube 101 is perpendicularly oriented with respect to the flat base 106. The flat base 106 being of a relatively thin thickness and generally a square shaped component that provides a sufficient area to support the invention 100 in an uprigth orientation during launching of the rocket 130.

The launching tube 101 includes an opening 107 to accommodate a door 103 that is attached to and pivots about a hinge 109. The door 108 is a unique feature of the launching tube 101 in that the tube 101 enables access to an interior 110 of the launching tube 101 in order to insert the rocket 130 prior to launching. The opening 107 is relatively close to the bottom distal end 104, but is lower than a middle 102A of the length 102 of the launching tube 101. The door 100 includes a plurality of holes 111 thereon, which enable air 150 to pass there through along with an applicable fuse 131 if so outfitted with the rocket 130.

It shall be noted that the ability of air 150 to enter and exit adjacent to the bottom distal end 104 is an improvement over traditional launching apparatuses. The flow of air 150 inside of the launching tube 101 will enhance the ability of the fuse 131 to burn without being deprived of oxygen, which is needed. Otherwise, a lack of oxygen inside of the launching tube 101 may result in the fuse 131 dying or otherwise stop burning, and thus the rocket 130 will not launch.

It shall be further noted that the door 108 includes a curvature 112 that is akin with the circular cross-section of the launching tube 101 such that when the door 108 is closed, the overall exterior shape of the launching tube 101 and the door 108 is consistent.

The launching tube 101 may further include a strap 113 that is used so secure the door 108 in a closed position (see FIGS. 1 and 3) during launching of the rocket 130. The strap 113 includes a fastening means 114 on a distal end, and is in the form of a nylon hook or loop strip that engages a corresponding nylon hook or loop strip found on the door 108.

The launching tube 101 further includes a handle 115 that attaches to the exterior surface 105 of the launching tube 101, and is used to transport the invention 100 between uses. The handle 115 is made of a flexible material and is defined by distal ends 116 that are rigidly attached to the exterior surface 105 of the launching tube 101. The handle 115 is ideally located on the exterior surface 105 of the launching tube 101 and opposite of the opening 107 so as to avoid interference there with.

As previously mentioned the invention 100 is adapted for use in launching rockets 130 and other fireworks. That being the case, it shall be noted that the length 102 of the launching tube 101 can vary dramatically in order to accommodate variously sized rockets 130 and fireworks alike, which may require a relatively large or small length 102 for the launching tube 101. Obviously, the length 102 of the launching tube 101 shall also take into consideration the pragmatics of size with respect to portability and use of the handle 115. Thus, the length 102 may vary from 12 inches to 12 feet, and have an inner diameter 117 varying from 1 inch to 1 foot. The range in sizes is obviously to accommodate for the range in applicable uses.

Figure 5:
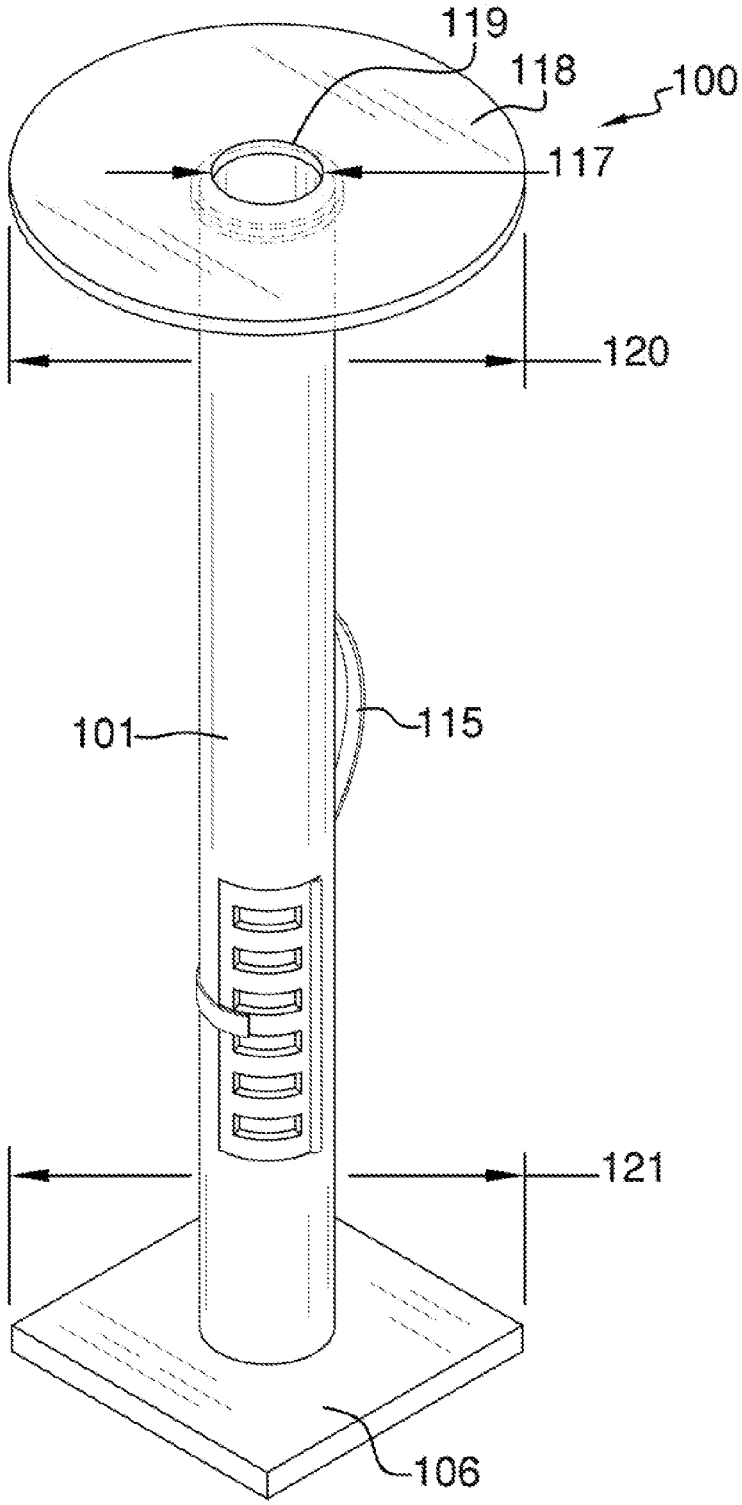
FIG. 5 illustrates a perspective view of the alternative embodiment including the fallout shroud extending and encircling the top distal end of the launching tube.

Referring to FIG. 5, the invention 100 may be outfitted with a fallout shroud 118 that attaches to and encircles around the top distal end 103 of the launching tube 101. The invention 100 of FIG. 5 may be referred to as an alternative embodiment in that the inclusion of the fallout shroud 118 adds en additional feature to the overall functionality of the invention 100. The fallout shroud 118 produces an umbrella of coverage from any sparks that may descend once the rocket 130 is being launched from the invention 100. The fallout shroud 118 is a disc-shaped member having an inner hole 119 that is not smaller than the inner diameter 117 of the launching tube 101 so as to prevent any lip from forming that may catch or interfere with the rocket 130 during launch. The fallout shroud 118 shall have an outer diameter 120 that is not greater than a diagonal 121 of the flat base 106. The fallout shroud 118 may be made of a clear material so as to enable visualization of the invention 100 at different orientations, and further enable visualization of the rocket 130 leaving the launching tube 101 during launching.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rocket launcher comprising:

a launching tube of an undefined length having a flat base affixed to a bottom distal end;

wherein an opening on the launching tube includes a door attached via a hinge, which enables access to the interior of the launching tube so as to insert a rocket or firework therein prior to launch there from;

wherein a handle attaches to an exterior surface of the launching tube for use in transport between uses;

wherein the launching tube is further defined with a top distal end, which is opposite the bottom distal end, and an inner diameter;

wherein a fallout shroud attaches to and encircles around the top distal end of the launching tube; wherein the fallout shroud is a disc-shaped member having an inner hole that is not less than the inner diameter of the launching tube;

wherein the fallout shroud has an outer diameter that is not greater than a diagonal of the flat base.

2. The rocket launcher as described in claim 1 wherein the launching tube is in perpendicular orientation with respect to the flat base.

3. The rocket launcher as described in claim 2 wherein the opening on the launching tube is adjacent the bottom distal end, and lower than a middle of the length.

4. The rocket launcher as described in claim 3 wherein the door includes a plurality of holes thereon, which enable air to pass there through.

5. The rocket launcher as described in claim 4 wherein the door includes a curvature that is identical with a circular cross-section of the launching tube such that when the door is closed, the overall exterior shape of the launching tube and the door is consistent.

6. The rocket launcher as described in claim 5 wherein the launching tube includes a strap that is used to secure the door in a closed position during launch of the rocket.

7. The rocket launcher as described in claim 6 wherein the strap includes a fastening means on a distal end, and is in the form of a nylon hook or loop strip that engages a corresponding nylon hook or loop strip found on the door.

8. The rocket launcher as described in claim 1 wherein the handle is located on the exterior surface of the launching tube opposite of the opening.

9. The rocket launcher as described in claim 1 wherein the length of the launching tube is not less than 12 inches, and not more than 12 feet.

10. The rocket launcher as described in claim 1 wherein an inner diameter of the launching tube is not less than 1 inch and not more than 1 foot.

11. A rocket launcher comprising:

a launching tube of an undefined length having a flat base affixed to a bottom distal end;

wherein an opening on the launching tube includes a door attached via a hinge, which enables access to the interior of the launching tube so as to insert a rocket or firework therein prior to launch there from;

wherein a handle attaches to an exterior surface of the launching tube for use in transport between uses;

wherein the launching tube is further defined with a top distal end, which is opposite the bottom distal end, and an inner diameter;

wherein the launching tube is in perpendicular orientation with respect to the flat base;

wherein the opening on the launching tube is adjacent the bottom distal end, and lower than a middle of the length;

wherein a fallout shroud attaches to and encircles around the top distal end of the launching tube; wherein the fallout shroud is a disc-shaped member having an inner hole that is not less than the inner diameter of the launching tube;

wherein the fallout shroud has an outer diameter that is not greater than a diagonal of the flat base;

wherein the fallout shroud is made of a clear material.

12. The rocket launcher as described in claim 11 wherein the door includes a plurality of holes thereon, which enable air to pass there through; wherein the door includes a curvature that is identical with a circular cross-section of the launching tube such that when the door is closed, the overall exterior shape of the launching tube and the door is consistent.

13. The rocket launcher as described in claim 12 wherein the launching tube includes a strap that is used to secure the door in a closed position during launch of the rocket; wherein the strap includes a fastening means on a distal end, and is in the form of a nylon hook or loop strip that engages a corresponding nylon hook or loop strip found on the door; wherein the handle is located on the exterior surface of the launching tube opposite of the opening.

14. The rocket launcher as described in claim 11 wherein the length of the launching tube is not less than 12 inches, and not more than 12 feet; wherein an inner diameter of the launching tube is not less than 1 inch and not more than 1 foot.

* * * * *